United States Patent [19]

Quakenbush

[11] 4,029,303

[45] June 14, 1977

[54] SPRING-FRAME CONSTRUCTION FOR SEATS AND THE LIKE

[75] Inventor: Howard M. Quakenbush, Apple River, Ill.

[73] Assignee: Flexsteel Industries, Inc., Dubuque, Iowa

[22] Filed: Jan. 9, 1976

[21] Appl. No.: 647,880

[52] U.S. Cl. ..... 267/110; 5/260

[51] Int. Cl.[2] ..... F16F 3/02

[58] Field of Search ..... 267/80, 101–103, 267/106, 107, 109–112; 5/237, 238, 247, 259 R, 259 B, 260, 282 B; 24/73 SS; 297/452, 456

[56] References Cited

UNITED STATES PATENTS

| | | | |
|---|---|---|---|
| 2,540,779 | 2/1951 | Forbes | 267/111 |
| 3,118,661 | 1/1964 | Cobb | 267/110 |
| 3,240,483 | 3/1966 | Slominski | 267/102 |
| 3,288,503 | 11/1966 | Slominski | 267/110 X |
| 3,356,359 | 12/1967 | Bond | 267/102 |
| 3,425,680 | 2/1969 | Garrison | 267/102 |
| 3,888,474 | 6/1975 | Mandusky et al. | 267/110 |

FOREIGN PATENTS OR APPLICATIONS

| | | | |
|---|---|---|---|
| 213,246 | 8/1956 | Australia | 267/111 |

*Primary Examiner*—Johnny D. Cherry
*Attorney, Agent, or Firm*—Brezina & Lund

[57] ABSTRACT

A spring-frame assembly is provided for seats or the like including a plurality of wire springs in horizontally spaced relation between a pair of horizontal tubular frame members in spaced parallel relation. A pair of clips are provided for each spring, receiving opposite end portions thereof and including hook sections extending over the frame members downwardly around the outside thereof and thence inwardly and further including retaining sections engaging over portions of the spring spaced inwardly from the end portions thereof. The springs are preferably sinuous springs pre-formed to assume an upwardly bowed configuration and to apply torques and forces on the clips insuring secure engagement of the clips with the frame members. The clips have a ribbed construction for increased strength with flanges to provide extended areas of contact with the frame members.

6 Claims, 3 Drawing Figures

SPRING-FRAME CONSTRUCTION FOR SEATS AND THE LIKE

This invention relates to a spring-frame assembly for seats or the like and more particularly to an assembly which includes a minimum number of parts which are readily assembled and which is otherwise easy and economical to manufacture, while being strong and reliable and providing optimum support. The assembly is such as to permit ready installation of cushioning and upholstering materials.

BACKGROUND OF THE INVENTION

Seats or the like of chairs, sofas and similar types of upholstered furniture have heretofore been constructed with springs of wire bent into a sinuous configuration to extend in spaced parallel relation between frame members such as front and rear horizontal frame members. In one type of construction, the front end of each spring is connected to a front frame member or rail of wood by a clip which is secured by nails to the front rail while the rear end of the spring is connected to a bar having a rearward end connected through a wire hinge link to a clip which is secured by nails to a rear wood rail. A suitable cushioning material is usually disposed on the springs and is covered by upholstering material. The weight of a person on the seat causes the spring to flex with the link being pivoted, the rearward end of the bar being moved in an arc about the axis of the pivotal connection of the link to the clip which is nailed to the rear rail.

In this type of construction, the bars and the wire links form in effect an open valley requiring filling material and with the pivotal movement of the link, there is an undesirable distortion of the cushioning or filling material and the upholstering material. There is some difficulty in obtaining and continuing a neat appearance especially after use of the seat for a substantial length of time. Further, the attachment of the clips to the wood rails by nails is not as secure and reliable as would be desirable. In addition, the proper assembly of parts in this type of construction, and in others similar thereto, is difficult and time-consuming and for this and other reasons, the constructions of this general type are more expensive than would be desirable.

SUMMARY OF THE INVENTION

This invention was evolved with the general object of overcoming the disadvantages of prior art constructions and of providing an assembly which can be economically manufactured while being rugged and durable.

A further object of the invention is to provide an assembly on which cushioning and upholstering materials may be readily installed and which provides optimum resilient support for the user.

In accordance with this invention, a spring-frame assembly is provided wherein springs of bent wire extend in spaced parallel relation and transverse relation to and between a pair of parallel horizontal frame members, and a pair of clips are provided for each spring receiving end portions of the spring which are adjacent to and inside the frame members and generally parallel to the axes thereof, the clips including hook sections extending part-way around the frame members on the outside thereof. With this simple arrangement, the springs are directly connected to the frame members and disadvantages of prior constructions are avoided. The springs may be readily installed, simply by hooking the hook sections of the clips around the frame members, and time-consuming installation operations are avoided. A further advantage is that the construction is very rugged and durable.

Each spring, which may preferably assume a sinuous configuration, is pre-formed to extend when in an unstressed condition in an arc having a predetermined relatively short radius of curvature with the straight-line chordal distance between the end portions thereof being substantially less than the distance between the frame members. Then when the spring is secured by the clips to the frame members, it is resiliently deformed to extend in an arc about an axis below the plane of the frame members with a radius of curvature substantially greater than the initial radius of curvature assumed in the unstressed condition. The hook sections of the clips preferably extend outwardly over the frame members, thence downwardly about the outside of the frame members and thence inwardly to terminal ends. The spring applies torques to the clips and exerts tensioning forces urging the clips toward each other. Such torques and forces combine to insure secure and reliable engagement of the hook portions of the clips with the frame members.

In accordance with an important feature, the frame members have generally cylindrical outer surfaces, being preferably tubular members of a steel or other metallic material, and the hook sections have frusto-cylindrical inner surfaces with a radius dimension approximately equal to that of the frame members. With this arrangement, the clips can pivot as required in response to the application of the weight of a user to the spring.

Another feature is in the provision of inwardly projecting retaining arm sections on the clips with each spring including a pair of portions spaced inwardly from and generally parallel to the end portions thereof and engaged with the undersides of the retaining arm sections of the clips.

Further features relate to the provision of a ribbed construction of the clips for increased strength with flanges which provide extended areas of contact with the frame members, and to a construction of the clips such that they can be readily and economically stamped from sheet metal.

This invention contemplates other objects, features and advantages which will become more fully apparent from the following detailed description taken in conjunction with the accompanying drawings.

DESCRIPTION OF A PREFERRED EMBODIMENT

Figure 1:
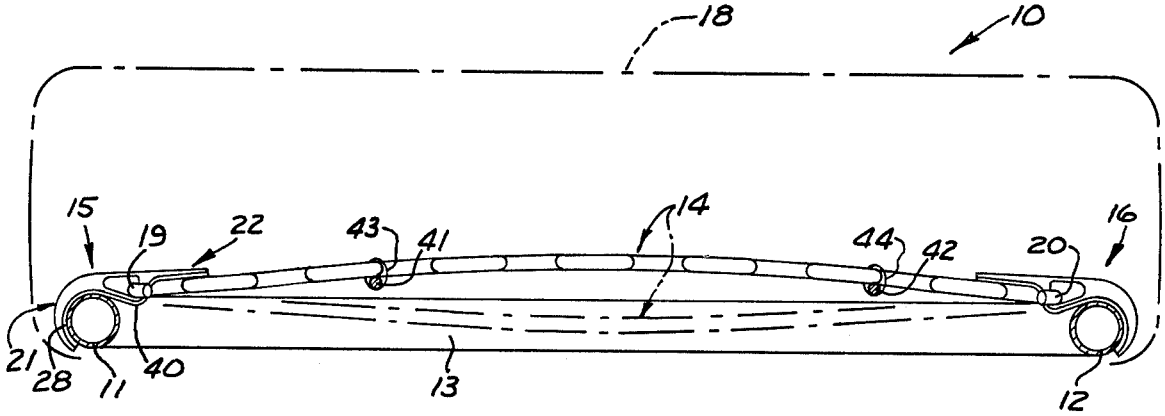
FIG. 1 is a sectional view showing a portion of a spring-frame assembly constructed in accordance with the invention.
Figure 2:
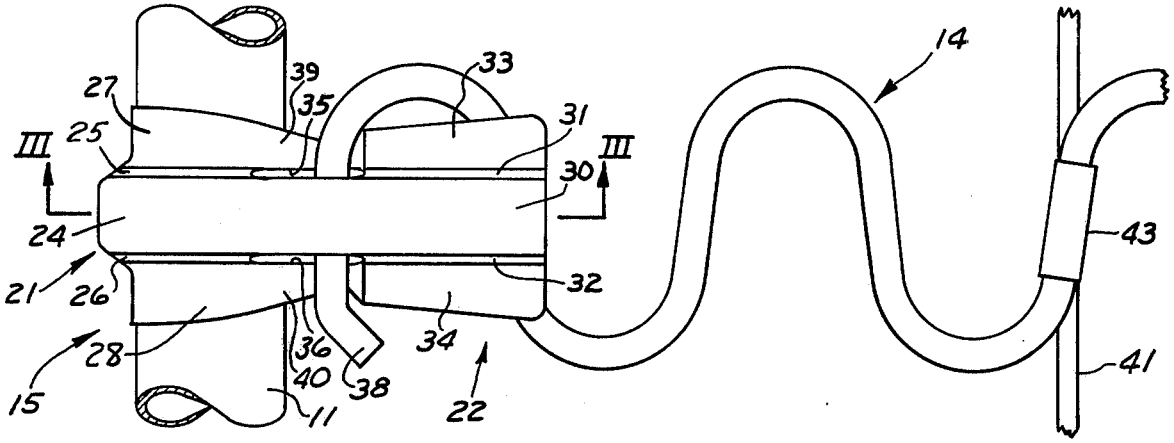
FIG. 2 is a top plan view of part of the structure of FIG. 1, on an enlarged scale.

Reference numeral 10 generally designates a spring-frame assembly constructed in accordance with the principles of this invention. The assembly 10 includes a pair of spaced parallel horizontal frame members 11 and 12, preferably tubular members of steel or other strong metallic material. Ends of the frame members 11 and 12 are welded or otherwise secured to ends of an end frame member 13, the opposite ends of the tubular frame members 11 and 12 being secured to another end member similar to the member 13. Intermediate connecting members may be provided between the members 11 and 12, depending upon the length of the assembly.

A plurality of springs formed of bent wire extend transversely between the frame members 11 and 12, one of such springs, designated by reference numeral 14, being shown in the drawings. The ends of the spring 14 are connected to the frame members 11 and 12 through a pair of clips 15 and 16 and it will be understood that the other springs of the assembly are secured to the frame members 11 and 12 by clips similar to the clips 15 and 16. After installation of the springs on the frame members 11 and 12, cushioning and upholstering materials may be applied to form a seat, the outline of the upper and front and rear surfaces of the seat so formed being indicated by broken line 18.

The illustrated spring 14 is formed by bending wire of spring steel into a sinuous or serpentine form such that when viewed from above or below, there are what may be described generally as a series of S-shaped bends in end-to-end relationship, there being provided a plurality of spaced horizontal portions which are generally parallel to the axes of the frame members 11 and 12. The spring 14 is so formed that in an unstressed condition, before installation, it extends in a curve with a predetermined radius of curvature and a predetermined arcuate length such that the straight-line chordal distance between the ends thereof is substantially less than the distance between the tubular frame members. For example, the spring, before installation, may extend substantially in a circle, with opposite end portions indicated by reference numerals 19 and 20 being adjacent one another.

When the spring is installed, the end portions 19 and 20 are moved apart to positions close to the tubular frame members 11 and 12, as illustrated, being retained by the clips 15 and 16. As illustrated, it is so installed as to be bowed upwardly with the central portion thereof being above a horizontal plane through the ends thereof. When, from a person's weight, a downward force is applied, the spring may be bowed downwardly to position the central portion below a plane through the ends thereof, as indicated in broken lines in FIG. 1.

Important features relate to the construction of the clips. The clip 15 will be described with particularity, it being understood that the clip 16 at the opposite end of the spring 14 and the clips for the other springs on the assembly have a substantially identical form. As shown, the clip 15 receives the end portion 19 of the spring 14 and includes a hook section 21 extending over the frame member 11, thence downwardly around the outside thereof and thence inwardly to a terminal end, the hook portion 21 having a frusto-cylindrical concave inner surface which has a radius dimension approximately equal to that of the tubular frame member 11. The clip may thus pivot about the axis of the frame member 11.

Figure 3:
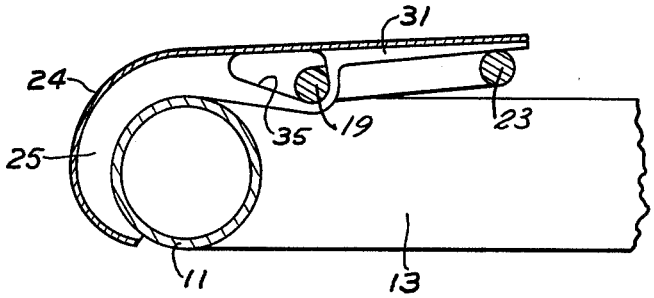
FIG. 3 is a sectional view taken substantially along line III—III of FIG. 2.

In addition, the clip 15 includes an inwardly projecting retaining arm section 22 the lower surface of which is engaged with the upper surface of a portion 23 of the spring 14, spaced inwardly from the end portion 19. It is noted that because of the stressing of the spring 14 in installation, a torque is applied to the clip 15 in a counter-clockwise direction, as viewed in FIGS. 1 and 3. In addition, the spring is so stressed as to be tensioned, and to exert a substantial inward force on the clip 15. The combined effect of the torque and force so applied is to insure secure engagement of the hook section 21 with the frame member 11.

Specific features of the construction of the clip 15 relate to the provision of a ribbed construction for increased strength and to flanges to provide extended areas of contact with the frame members, with the construction being such that the clip can be readily and economically stamped from sheet metal. In particular, the hook section 21 includes an arcuate wall portion 24 extending generally in an arc about the axis of the frame member 11 and a pair of radial wall portions 25 and 26 extending generally radially inwardly from edges of the arcuate wall portion 24. In addition, the hook section 21 includes a pair of arcuate flange portions 27 and 28 extending in opposite axial directions from inner edges of the radial wall portions 25 and 26 and in arcs about the axis of the frame member 11, the inner surfaces of the arcuate flange portions 27 and 28 being engaged with the outside surfaces of the frame members. Preferably, the inner surfaces of the arcuate flange portions 27 and 28 may be coated with a wax-like or other lubricating material to permit free pivotal movement of the clip 15 and to prevent the generation of any squeaking or other noises.

The retaining arm section 22 includes an upper wall portion 30 forming an inward extension of the wall portion 24 of the hook section 21 and a pair of wall portions 31 and 32 extending downwardly from opposite edge portions of the wall portion 30, with a pair of flange portions 33 and 34 extending in opposite axial directions from lower edges of the wall portions 31 and 32, lower surface portions of the flange portions 33 and 34 being engaged with the portion 23 of the spring 14. The inner ends of the wall portions 25 and 26 are spaced outwardly from the outer ends of the wall portions 31 and 32 to provide aligned openings 35 and 36 for receiving the end portion 19 of the spring 14. Preferably, the portion 19 is a terminal end 38 turned inwardly to insure retention of the portion 19 in the openings 35 and 36.

The clip 15 may further include additional flange portions 39 and 40 extending under the openings 35 and 36 from inner ends of the arcuate flange portions 27 and 28 to outer ends of the flange portions 33 and 34 of the retaining arm section 22. As shown, the inner ends of the flange portions 39 and 40 may be turned upwardly, to be positioned on the inside of the end portion 19 of the spring 14.

Preferably, the wall portions 25 and 26 as well as the wall portions 31 and 32 may converge to a certain extent toward the wall portions 24 and 30 for facilitating formation of the clip by stamping operation.

The ribbed construction coupled with the provision of the flange portions provide a strong and rigid construction to carry the load applied by the spring and the added load of an occupant with deformation so that substantially the full area of the inner surfaces of the flange portions 27 and 28 are in engagement with the outer surface of the frame member 11. The bearing engagement is such as to assure lateral stability of the spring.

It is noted that the wall sections 31 and 32 are relatively thin at the inner terminal ends thereof to minimize protrusion into the cushioning material, and to prevent the clip from being felt through the cushioning or filling material. Also, the terminal end of the hook section 21 is relatively thin to allow the upholstering material to be secured to the underside of the frame member 11 without causing the formation of any visible protrusion.

By virtue of the specific features of construction above described, the clip 15 is very strong and durable while the amount of metal used is minimized.

The ends of the spring 14 are positioned quite close to the frame members 11 and 12 and disadvantages of prior constructions are avoided, retaining to the filling in of gaps or troughs with cushioning or filling material and a neat appearance of the seat is insured, even after extensive use. The use of tubular metallic frame members is in itself an advantage in reducing cost of manufacture and the springs can be readily and quickly installed to further minimize the expense of manufacture. It may be noted that tie wires such as wires 41 in the illustrated arrangement may be provided for interconnecting the springs, the tie wires 41 and 42 being preferably coated paper and connected to portions of the springs through suitable clips 43 and 44.

It is noted that the illustrated embodiment is intended for use in a seat portion of a sofa or the like but may be used in back portions of upholstered furniture or for beds in which, for example, a mattress may be placed on top of the springs, without permanent attachment of cushioning and upholstering material. Also, the assembly need not be positioned as illustrated and described but may be used in a back construction, for example, and terms such as "horizontal", "downward", "upward" and the like are used only for ease of description and are not to be construed as limitations.

It will be understood that modifications and variations may be effected without departing from the spirit and scope of the novel concepts of this invention.

I claim as my invention:

1. In a spring-frame assembly for seats or the like, a pair of spaced parallel horizontal frame members, a spring extending transversely between said frame members, said spring being formed of bent wire and including opposite end portions adjacent to and inside said frame members and generally parallel to the axes thereof, and a pair of clips receiving said end portions of said spring and including hook sections extending part way around said frame members on the outside thereof, said spring being pre-formed to extend when in an unstressed condition in an arc having a predetermined radius of curvature with the straight-line chordal distance between said end portions thereof being substantially less than the distance between said frame members and being resiliently deformed when secured by said clips to said frame members to extend in an arc about an axis below the plane of said frame members and having a radius of curvature substantially greater than said predetermined radius of curvature, said hook sections extending outwardly over said frame members then downwardly about the outside of said frame members and thence inwardly to terminal ends, said frame members having generally cylindrical outer surfaces, and said hook sections having frusto-cylindrical inner surfaces with a radius dimension approximately equal to that of said frame members, said hook sections of said clips including arcuate wall portions extending generally in arcs about the axes of said frame members and including pairs of radial wall portions extending generally radially inwardly from edges of said arcuate wall portion, said hook sections of said clips further including pairs of arcuate flange portions extending in opposite axial directions from inner edges of said radial wall portions and in arcs about the axes of said frame members, the inner surfaces of said arcuate flange portions being engaged with the outside surfaces of said frame members.

2. In an assembly as defined in claim 1, said clips having inwardly projecting retaining arm sections including upper wall portions forming inward extensions of said arcuate wall portions of said hook sections, pairs of wall portions extending downwardly from opposite edge portions of said upper wall portions and flange portions extending in opposite axial directions from lower edges of said downwardly extending wall portions, and said springs including a pair of portions spaced inwardly from and generally parallel to said end portions thereof and engaged with the undersides of said flange portions of said retaining arm sections of said clips.

3. In an assembly as defined in claim 2, the inner ends of said radial wall portions of said hook sections of said clips being spaced outwardly from the outer ends of said downwardly extending wall portions of said retaining sections of said clips to form aligned openings for extension of said end portions of said springs therethrough.

4. In an assembly as defined in claim 3, said clips having additional flange portions extending under said openings and said end portions of said spring from inner ends of said flange portions of said hook sections to outer ends of said flange portions of said retaining sections.

5. In an assembly as defined in claim 4, said additional flange portions being turned upwardly at the inner ends thereof.

6. In a spring-frame assembly for seats or the like, a pair of spaced parallel horizontal frame members having generally cylindrical outer surfaces, a spring extending transversely between said frame members, and a pair of clips securing opposite end portions of said spring to said frame members, said spring being formed of wire bent into a generally sinuous form and including a pair of end portions generally parallel to the axes of said cylindrical outer surfaces of said frame members and an additional pair of portions parallel to said end portions and spaced inwardly therefrom, said clips having openings receiving said end portions and including inwardly projecting retaining arm sections having downwardly facing surfaces engaging upper surfaces of said additional pair of portions, said clips further including hook portions extending outwardly over said frame members thence downwardly about the outside of said frame members and thence inwardly to terminal ends and having frusto-cylindrical inner surfaces in bearing engagement with and having substantially the same radial dimension as said generally cylindrical outer surfaces, said spring being pre-formed to extend when in an unstressed condition in an arc having a predetermined radius of curvature with the straight line chordal distance between said end portions thereof being then substantially less than the distance between said frame members and being resiliently deformed when secured by said clips to said frame members to extend in an arc about an axis below the plane of said frame members and then having a radius of curvature substantially greater than said predetermined radius of curvature with said clips forming extensions of the arc formed by said spring, said spring being effective to apply forces urging said clips toward each other to engage said hook portions with said frame members and also being effective to apply torques to said clips with forces being exerted between said additional pair of portions of said springs and said downwardly facing surfaces of said retaining arm sections, and said bearing engagement between said inner surfaces of said hook sections and said outer surfaces of said frame members being effective to allow pivotal movement of said clips about the axes of said frame members in response to downward forces applied to central portions of said springs.

* * * * *